US012768185B2

(12) United States Patent
Dell

(10) Patent No.: US 12,768,185 B2
(45) Date of Patent: Oct. 20, 2026

(54) EXPANDABLE WEDGE DECK PANEL FOR A MODULAR DECK SYSTEM

(71) Applicant: TAIT TOWERS MANUFACTURING, LLC, Lititz, PA (US)

(72) Inventor: Douglas Lawrence Dell, Lancaster, PA (US)

(73) Assignee: TAIT GLOBAL LLC, Lititz, PA (US)

( * ) Notice: Subject to any disclaimer, the term of this patent is extended or adjusted under 35 U.S.C. 154(b) by 219 days.

(21) Appl. No.: 18/643,190

(22) Filed: Apr. 23, 2024

(65) Prior Publication Data

US 2025/0327322 A1 Oct. 23, 2025

(51) Int. Cl.
*E04H 3/28* (2006.01)

(52) U.S. Cl.
CPC ..... *E04H 3/28* (2013.01)

(58) Field of Classification Search
CPC ..... E04H 3/28; E04H 3/26
See application file for complete search history.

(56) References Cited

U.S. PATENT DOCUMENTS 1,819,656 A * 8/1931 Pressley ..... A63J 1/00 472/75
8,136,460 B2 3/2012 Tait et al.
9,082,325 B2 7/2015 Davis et al.
9,259,639 B2 2/2016 Davis
9,441,382 B2 * 9/2016 Hokanson ..... E06C 7/182
9,622,568 B1 * 4/2017 Lin ..... A47B 13/081
10,939,676 B1 * 3/2021 Harter ..... E04G 5/10
11,684,151 B2 * 6/2023 Jiang ..... A47B 1/04 108/86
11,718,426 B1 * 8/2023 Duschl ..... B64G 5/00 244/171.6
2013/0319796 A1 * 12/2013 Davis ..... E04H 3/28 14/71.1
2015/0166198 A1 * 6/2015 Hokanson ..... E06C 1/12 182/101
2019/0292776 A1 * 9/2019 Maxam ..... E04B 2/7407

FOREIGN PATENT DOCUMENTS

GB 361238 A * 11/1931 ..... A63J 1/00

* cited by examiner

*Primary Examiner* — Brian D Mattei
(74) *Attorney, Agent, or Firm* — Saxton & Stump, LLC

(57) ABSTRACT

An adjustable wedge panel for a modular platform system includes a first frame having a first receiver member and a first platform portion, a second frame having second receiver member and a second platform deck portion, wherein the frames are supportable above a surface by support members engaged in the first and second receiver members. The first and second frame members are angularly adjustable between a first angular position and a second angular position, the platform portions being positioned between the frames to define a support surface in the form of an annular sector having a sector angle. The adjustable wedge panel module may be joined to other modular platform assemblies, whether rectangular or other adjustable wedge panels, to create curved platforms. The adjustability of the wedge panel module allows a single module to replace multiple fixed-angle wedge panels.

17 Claims, 11 Drawing Sheets

EXPANDABLE WEDGE DECK PANEL FOR A MODULAR DECK SYSTEM

FIELD OF THE INVENTION

The present disclosure is generally directed to modular stage structures and, more particularly, to an adjustable wedge deck panel section that enables angular adjustment of stage runways.

BACKGROUND OF THE INVENTION

The use of temporary stages in the modern entertainment industry which may be easily assembled and disassembled in a large number of venues is de rigueur. It is desirable for such stages and platforms to be capable of assembly and disassembly into relatively small units that can be compactly and quickly loaded transport to the next venue. In response, modular stage structures have been developed in which interlocking plates are joined to create deck surface which is elevated above the floor or ground by support legs. Bracing between support legs may be provided to stabilize the deck surface and increase the load-carrying capability of the stage. These modular stage systems rely on a limited number of standard elements that can be assembled in virtually unlimited configurations to fit the stage within the allowable space in a particular venue.

Many stages incorporate curved runways and other non-linear elements. In a modular stage system, wedge- or pie-shaped platform elements of various dimensions are necessary to allow the desired angular change in a stage runway to be constructed. Typical wedge sections of 30-degree and 45-degree arc sectors may be provided to incorporate curved sections into the stage system. Such fixed sections limit the stage design. More elaborate designs incorporating non-regular angles require the production of custom-sized wedge sections to implement the stage design.

What is needed is a wedge deck panel for a modular stage system that may be selectively adjusted to span a sector of a desired angle and provide a stable platform surface regardless of the angle. Additional benefits would be realized by an adjustable wedge deck panel that may be integrated into an existing modular platform system.

SUMMARY OF THE INVENTION

Accordingly, the present invention, in any of the embodiments described herein, may provide one or more of the following advantages:

In one embodiment, an adjustable wedge panel for a modular platform system includes a first frame having a first platform portion and a receiving member, a second frame having a second platform portion and a receiving member, the second frame being angularly moveable in relation to the first frame, and the receiving members engageable by a support member to support the first and second frames above a surface. The first and second frames are moveable between a first angular position and a second angular position while maintaining the first and second platform portions substantially co-planar.

In another embodiment, an adjustable wedge panel for a modular platform system includes a first frame and a second frame each angularly moveable to the other between a first angular position and a second angular position. Each frame extends along a radius extending from a center point location with the platform portions positioned between the frames to define an annular sector. The included sector angle may range between 22.5 degrees and 45 degrees.

In another embodiment, an adjustable wedge panel for a modular platform system includes a first frame having a first platform portion, and a second frame having a second platform portion. The first and second platform portions comprise intermeshing combs which slide in relation to one another as the frames are moved between the first and second angular positions. The intermeshing combs are configured to minimize gaps and openings in the platform portions which could pose a tripping or fall hazard to personnel on the modular platform system.

In another embodiment, an adjustable wedge panel for a modular platform system includes first frame having a receiver member and a second frame having a receiving member, the first and second frames being angularly moveable between a first angular position and a second angular position. The first and second frames each include a locking channel with a key engageable in locking channels on adjacent panel assembly frames in the modular platform system. The adjacent panel assemblies may be either moveable or non-moveable as the platform system configuration requires.

In another embodiment, an adjustable wedge panel for a modular platform system includes first frame having a receiver member and a locking channel with a key engageable therein, and a second frame having a receiving member and a locking channel with a key engageable therein, includes a static frame with receiver member and a locking channel with a key engageable therein, each receiver member including a magnetic panel configured to magnetically attract a receiving member on an adjacent frame member to aid in platform system assembly.

In an embodiment, a method of creating curved areas in a modular platform system includes installing an adjustable wedge panel including a first frame having a first platform portion and a receiving member, a second frame having a second platform portion and a receiving member and supporting the wedge panel above a surface by engaging one or more support members into the receiving members. The first and second frame members are angularly adjustable between a first angular position and a second angular position, the platform portions being positioned between the frame to define an annular sector. The adjustable wedge panel module may then be joined to other modular assemblies, whether rectangular or other adjustable wedge panels, to create curved platforms. The adjustable wedge panel may be adjustable between 22.5 and 45 degrees which allows the same panel module to be used in applications requiring any curved sweep within the range. Similarly, in a modular platform system requiring curved sweep sections of both 30 degrees and 45 degrees, a single module design can be adjusted for use in both applications, eliminating the need to provide two uniquely-sized wedge panels for the application.

It is a still further object of the present invention to provide an adjustable wedge panel for a modular platform system that is durable in construction, easily assembled, and simple and effective to use.

Other features and advantages of the present invention will be apparent from the following more detailed description of the preferred embodiment, taken in conjunction with the accompanying drawings which illustrate, by way of example, the principles of the invention.

BRIEF DESCRIPTION OF DRAWINGS

The advantages of this invention will be apparent upon consideration of the following detailed disclosure of the invention, especially when taken in conjunction with the accompanying drawings wherein.

Wherever possible, the same reference numbers will be used throughout the drawings to represent the same parts.

DETAILED DESCRIPTION OF THE INVENTION

Provided is a platform system, an adjustable wedge deck module assembly, and a method of assembling a platform system incorporating curved elements. Embodiments of the present disclosure permit ease of assembly and disassembly, reduce or eliminate assembly errors, increase stability of (for example, by reducing swaying, bending, and other lateral forces), permit individuals with little or no technical skill to assemble and/or disassemble platform systems, permits assembly and/or disassembly by hand, or combinations thereof.

Figure 1:
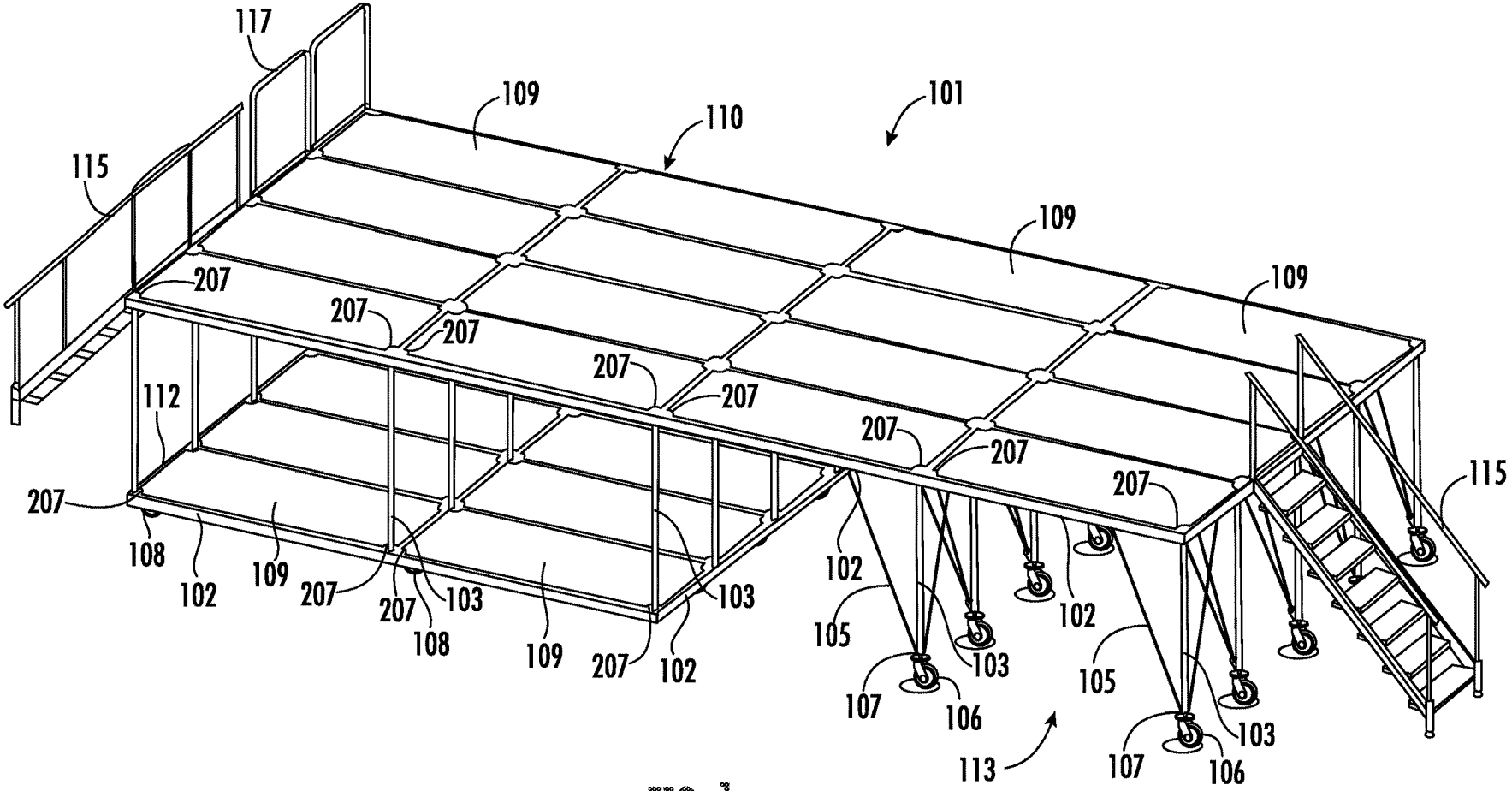
FIG. 1 shows an exemplar platform system of the type in which the present invention is useful.

FIG. 1 shows a platform system 101 comprising a plurality of frames 102 supported by portable supports 103, a plurality of secondary supports 105, and having a plurality of the platform panels 109 thereon. The platform panels 109 may be any type of panels 109 desirable for use with the platform system 101. In addition, panels 109 may include structural, aesthetic and/or theatrical components. For example, the platform panels 109 may include plywood, glass, metal, video components, lighting components, or any other structural, aesthetic and/or theatrical component. The frames 102 generally define a perimeter for the panel and may include features to allow adjacent panels/frames to be joined to form the modular platform system. In addition, the frames 102 each include four receiving members 207 (see e.g., FIGS. 2 and 3). Although this embodiment is shown with frames 102 having four receiving members 207, the frames 102 may contain any number of receiving members 207 suitable for providing the support for the frame 102 and the panels 109. The embodiment shown in FIG. 1 includes a multilevel portion 110 and a single level portion 113. Each of the multilevel portion 110 and the single level portion 113 are made up of a plurality of frames 102 and panels 109. The frame 102 and panels 109 on the upper section 111 of the multilevel portion 110 are supported by a plurality of portable supports 103. The portable supports 103 extend from the lower section 112 of the multilevel portion 110. The portable supports 103 are engaged with receiving members 207 of frames 102 in the lower section 112. The portable supports 103 in the multilevel portion 110 may be friction fit and held by gravity or may be locked into place with a locking mechanism (see e.g., FIGS. 2-3). Other mechanisms may be provided to further engage the portable supports 103 to the receiving members 207. For example, grooves, features, and interlocking features may be utilized to further provide engagement between the portable support 103 and receiving member 207. The single level portion 113 includes a plurality of portable supports 103 arranged to support a single level of frames 102 and panels 109. The portable supports 103 in the single level portion 113 includes secondary supports 105 that engage the frame 102 and the secondary support structure 107. The secondary supports 105 provide increased resistance to lateral forces.

Also shown in FIG. 1 are wheels 106, which provide contact with the underlying surface of the platform system 101. Although wheels 106 are shown, other structures may be utilized including, but not limited to, rollers, fixed feet, stakes, posts, or other structures suitable for engaging the surface underlying the platform system 101. As shown in the multilevel portion 110, the wheels 106 are attached to the panels 109 and/or frame 102 to permit rolling or moving of the system 101 even after assembly. Likewise, the single level portion 113 includes footing structures 108 having wheels that are attached to the portable support 103 and permit rolling or moving of the system 101 even after assembly. In another embodiment of the disclosure the footing structures 108 can be substituted with a stabilizing device. The stabilizing device could be a device formed of a solid substance (such as concrete, plastic, or other solids that can be worked with in liquid form), a mechanical system providing shock absorption, or other systems sufficient to provide stability for the portable support 103 and/or frame 102.

The receiving members 207 arranged along the frame 102 to permit engagement with portable supports 103 from either the top surface or from the bottom to permit stacking of platform levels. That is, portable supports may be mated to the receiving member 207 from two directions, permitting the formation of multiple levels. Although the multilevel portion 110 is shown as two platform levels, any number of additional levels may be formed. In addition, the distance between platform levels may vary by providing portable supports 103 of varying lengths on each level.

In addition, the receiving members 207 permit engagement with additional staging structures desirable for staging or platform use. For example, while not so limited, as shown in FIG. 1, additional staging structures, such as stairs 115, may be engaged to the platform system 101 by insertion of a portion thereof into receiving members 207. Likewise, railings 117 may also be inserted into receiving members 207. Engagement may include any suitable engagement into receiving member 207, including, but not limited to gravity, interlocking, latching or magnetic attraction. Other staging structures may likewise be engaged to the platform system 101 by engagement with the receiving member.

Figure 2:
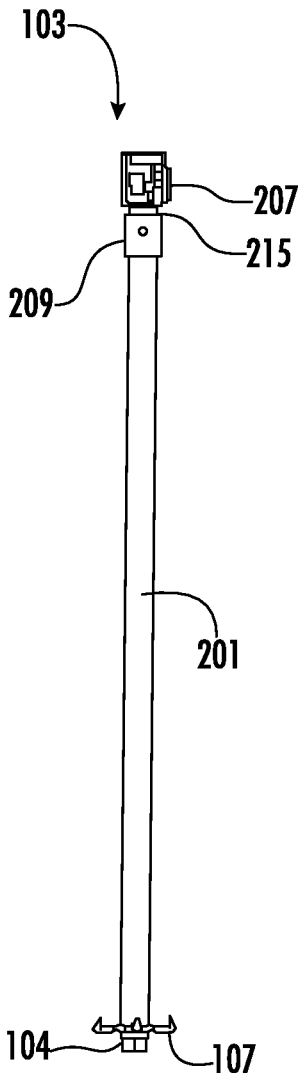
FIG. 2 shows an exploded view of a receiver member and support member connector used to support the platform system above a surface.
Figure 3:
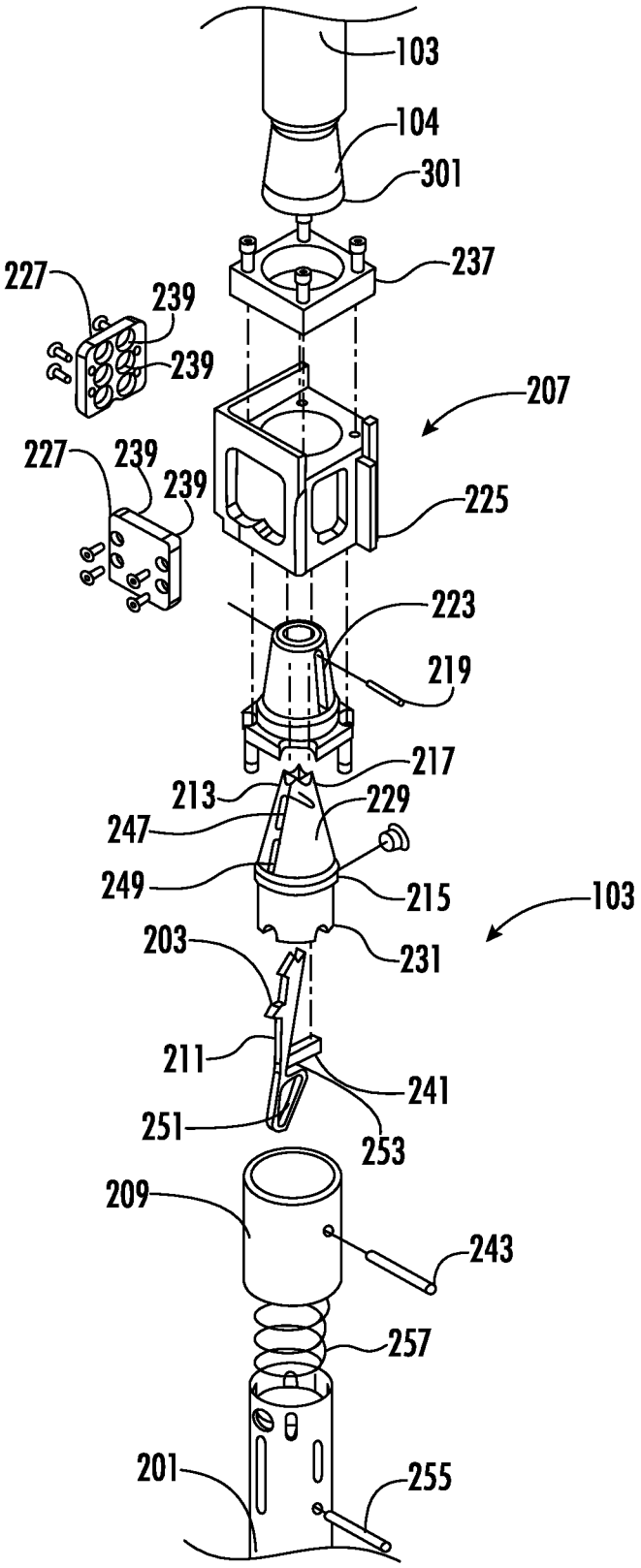
FIG. 3 shows a support member used to support the platform system above a surface.
Figure 4:
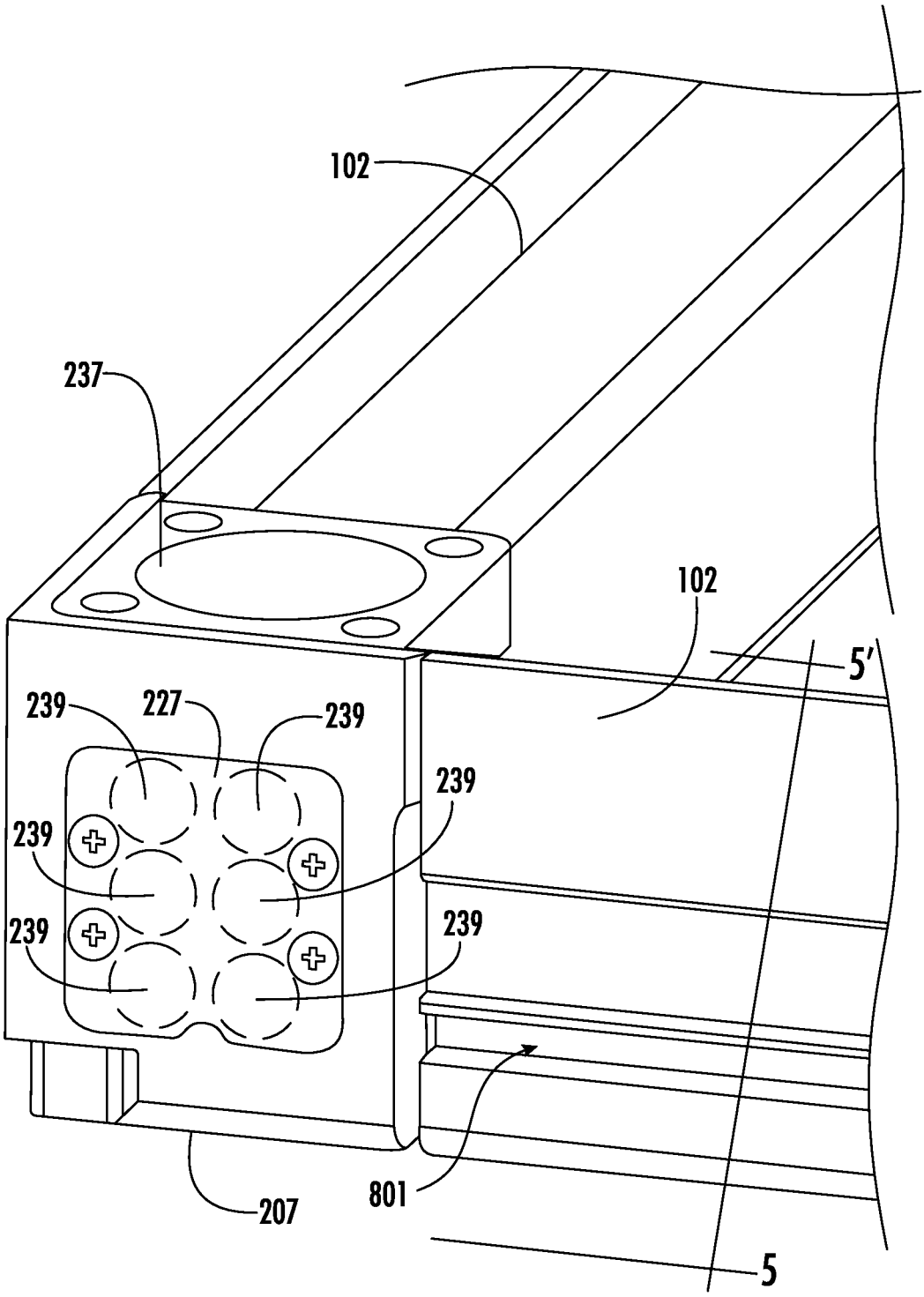
FIG. 4 shows an alternate view of the receiver member of FIG. 3 and a partial view of the a frame.

FIGS. 2 through 4 show an embodiment of the portable support 103 engaged with a receiving member 207 according to an embodiment of the present disclosure. The portable support 103 comprises a support member 201, a locking mechanism, and a footing structure 104. The portable support 103, as shown in FIG. 2, is substantially a cylindrical support but could be of any geometry capable of supporting the frame 102 and panels 109 and loads provided thereon. The support member 201 can be made of any material but is best made of light weight and durable materials that can withstand external environmental conditions, abuse by people of little or no technical skill, and frequent transportation. The support member 201 is also best made of a material that allows for the application of a coating. This coating can be used for aesthetic purposes or to improve the ability of the support member 201 to withstand external environmental conditions. In one embodiment, a plurality of the support members 201 may be fabricated with substantially identical dimensions or marked with an identifier, such as colors, to allow the support members 201 to be interchanged, reducing the possibility for assembly error, especially in the assembly of the multilevel platform system 101.

The tapered portion 229 is attached to or unitarily formed at an end of the support member 201. A footing structure 104 is attached to an end of the support member 201 opposite tapered portion 229. As shown in FIG. 2, the tapered portion 229 is engaged with receiving member 207.

One embodiment of the present disclosure, as visible in FIG. 3, includes a locking mechanism made up of a retention device 211, latching feature 203, alignment member 213, flange 215, tapered portion 229, attachment portion 231, and at least one channel 217. In the system 101 shown in FIG. 1, the locking mechanism is present in the portable supports 103 present in the single level portion 113. The locking mechanism may be positioned in multiple orientations by lining up channel 217 with the pin 219 of the receiving member 207 (see e.g. FIG. 3). Releasing mechanism 209 is arranged along a surface of the support member 201. The releasing mechanism 209 is preferably arranged as a sleeve or otherwise grippable structure that is manipulatable by hand. The releasing mechanism 209 can be operated by hand to disengage the retention device 211 and latching feature 203. The latching feature 203 is a latch, protrusion or other feature of the retention device 211 that engages one or more surfaces of the receiving member 207. The latching feature 203 extends through the tapered portion 229 and provides a surface extending therefrom that is capable of engaging a surface of the receiving member 207. As shown in FIG. 3, a series of mounting pins 243 and springs 241 are operably mounted to provide the releasably pivotable structure of the retention device 211 and the releasing mechanism 209. However, the structure of the portable support is not limited to the particular arrangement shown in FIG. 3.

The receiving member 207 comprises support cone 223, pin 219, and casing 225. The support cone 223 is geometrically configured to allow the locking mechanism to substantially fit within the support cone 223. The pin 219 is replaceably affixed within the support cone 223 to allow at least one of the channels 217 of the locking mechanism 203 to engage the pin 219. The casing 225 includes a geometry that allows the portable support 103 to support the platform panel 109 (shown in FIG. 1), stage, or platform system 101. As shown in FIGS. 2 and 3, the casing 225 of the receiving member 207 can include at least one magnetic panel 227. The magnetic panel 227 includes a plurality of magnets 239 that are arranged to magnetically attract adjacent receiving members 207. In one embodiment the magnetic panel 227 includes six magnets 239 having alternating polarities of north and south. For example, the magnets 239 may be arranged in a north-south-north arrangement in a first set and a south-north-south arrangement in a second, adjacent set. The arrangement of alternating magnetic polarities permits the simultaneous attraction and alignment along multiple directions from receiving members 207 having magnets 239 arranged in a corresponding arrangement.

Operation of locking mechanism is now described. A pin secured in tapered portion 229 also provides a pivotable connection with retention device 211. As shown in FIG. 4, slots 247 and 249 are found in tapered portion 229. Slot 247 provides visibility of the interior of tapered portion 229 to simplify installation of pin through retention device 211. Latching feature 203 extends through slot 249 to permit engagement with a lip in receiving member 207. An opening 251 is formed in retaining device 211 to receive pin 243 that is secured in releasing mechanism 209. Disposed between opening 251 and latching feature 203 is a protrusion 253 that is configured to receive spring 241. Spring 241 urges locking mechanism 203 to pivot about pin 245 so that locking mechanism 203 extends through tapered portion 229. A spring 257 is disposed between a pin 255 secured in support member 201 and pin 243 secured in releasing mechanism 209. Spring 257 urges releasing mechanism 209 to move along support member 201 toward tapered portion 229.

The receiving member 207 further includes a pin 219. The pin 219 is of a geometry configured to mate channel 217 of the locking mechanism 203 and provide rotational positioning of the portable support 103. Although an embodiment includes a single pin 219, multiple pins 219 can be used. The pin 219 can be of a cylindrical geometry, a cuboid geometry, or any substantially similar geometry. During the initial assembly of the receiving member 207, pin 219 may be inserted into two cavities on opposite sides of the support cone 223. Preferably, the pin 219 can be removed or replaced allowing the remaining parts of the receiving member 207 to be used if the pin 219 becomes damaged. In one preferred embodiment, the location of the pin 219 in the support cone 223 is as close to the distal end of the support cone 223 in relation to the support member 201 as possible. In another embodiment of the present disclosure, instead of having the pin 219, the receiving member 207 is configured with at least one alternate channel corresponding to the channel 217 of the alignment member 213.

The support cone 223 of the receiving member 207 is of a geometry substantially similar to the tapered portion 229 allowing the locking mechanism, including the tapered portion 229 and latching feature to fit inside of the support cone 223 and engage therewith. In one embodiment, the geometry of the support cone 223 resembles a frusto-conical geometry. The support cone 223 is made of a material that can withstand insertion of the locking mechanism 203 without the need to expend significant effort to align the locking mechanism 203 and the support cone 223. The support cone 223 preferably further includes a geometry to receive a tapered footing structure 104, stairs 115, railing 117 or other structures. The tapered surfaces of the support cone 223 may be the same or different. That is, the angle of the tapered surface may be the same or dissimilar on opposite edges of the support cone 223 (see e.g., FIG. 5). In the embodiment wherein the tapered surface are of different angles, the fitting of the components can be verified or customized to particular, predetermined components to prevent mis-assembly with insertion of incorrect components. In one embodiment, the support cone 223 is made of a material that can withstand the impact of the locking mechanism 203 being repeatedly and forcibly inserted into the support cone 223. Upon insertion of the portable support 103, the mating latching feature 203 of the retention member 211 latches a lip 218 or other surface or feature formed in the receiving member 207.

The casing 225 of the receiving member 207 is an external portion of the receiving member 207, providing attachment to frame 102 and providing structural support for the support cone 223. In one embodiment, the casing 225 is of a cuboid geometry. However, the casing 225 could be in the geometry of a cube, other hexahedron, or any other geometry with a top surface that is flat and at least one side surface that is flat. Having additional flat surfaces is preferred because the casing 225 can then be placed under the corner of a platform system 101 or under any other part of the platform system 101. A collar 237 is attached to the casing 225 with fasteners or by other methods and provides alignment of engaging structures and protects the components within and on the receiving member 207. Further, although not shown, collar 237 may be fitted with a cap or other structure to conceal the internal components, such as the support cone 223, of the receiving member 207 in the event that it is not desired to include structure on the upper side of the receiving member. The configuration of casing 225 allows for easier assembly of the platform system 101 because the receiving members 207 can be treated as interchangeable and a plurality of frames 102 having receiving members 207 may be brought together. Another aspect of an embodiment includes having at least one magnetic panel 227 on the side surface of the casing 225. The magnetic panel 227 allows for metal plates to be magnetically attached to the casing 225. Otherwise, the plates are attached with adhesives or hardware. In the platform system 101 the metal plates attached to multiple casings 225 provide a front surface for the stage, preventing people from walking underneath the platform system 101 and providing aesthetic benefits. In one embodiment, two flat side surfaces on the casing have magnetic panels 227. The arrangement allows for the receiving member 207 to be placed under the corner of the platform system 101 or any other part of the platform system 101, allowing for easier assembly of the platform system 101 because the receiving members 207 can be treated as interchangeable.

In operation, in response to receiving member 207 being aligned and directed over and into engagement with tapered portion 229 of portable support 103, the inside surface of support cone 223 makes contact with latching feature 203. Further directed movement of receiving number 207 with respect to portable support 103 urges latching feature 203 to pivotably retract through slot 249 sufficiently to permit latching feature 203 to engage the lip in the receiving member. This engagement, normally accompanied by an audible "click", secures receiving member 207 to portable support 103.

FIG. 4 shows a portion of the platform system 101 wherein the frame 102 is attached to the receiving member 207. A magnetic panel 227 provides magnets 239 arranged to align and engaged adjacent frames 102 and magnetic panels 227. In one embodiment, the magnets 239 are preferably disposed in a north-south-north polarity arrangement to provide the alignment. In addition, as shown the frame 102 is attached to receiving member 207. The attachment may be provided by any suitable attachment technique, including welding, adhesive, fasteners, interlocking or any other attachment that provide sufficient retention to support the frame 102, the panel 109 and any load thereon.

Figure 5:
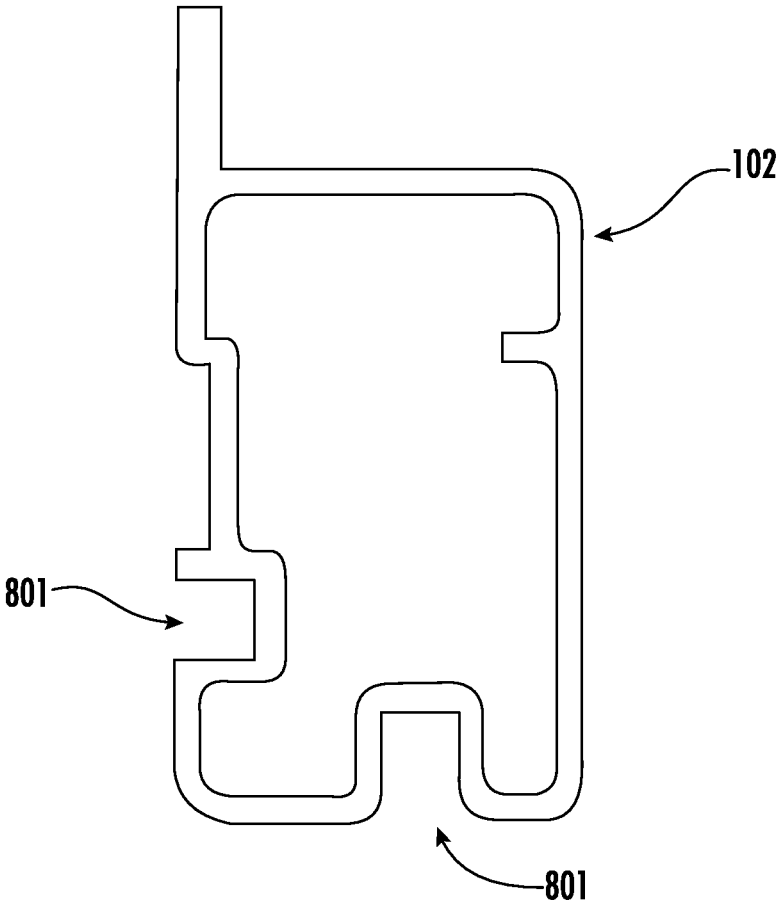
FIG. 5 shows a cross section view of a portion of a frame member of FIG. 4, taken along cut line 5-5.
Figure 6:
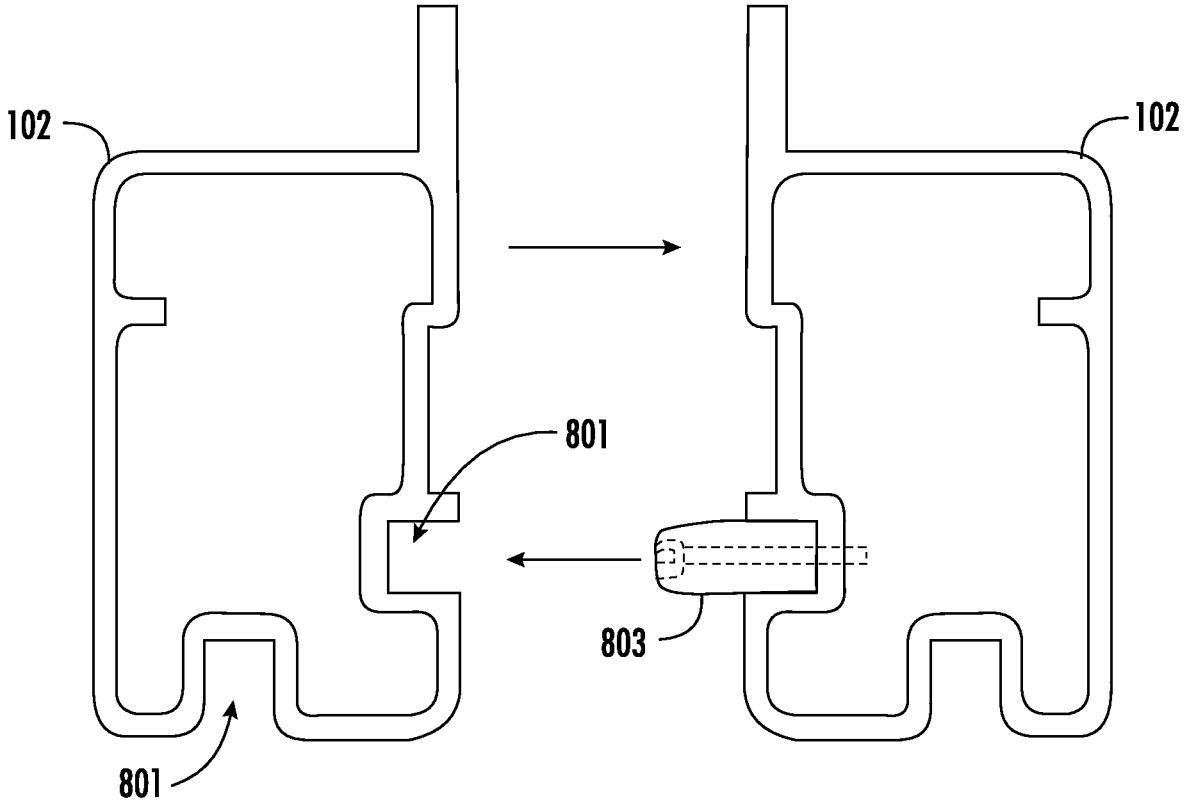
FIG. 6 shows a cross section view of two adjacent frame members as they are joined in a modular platform.

FIG. 5 shows a portion of an embodiment of the frame 102 according to embodiments of the present disclosure. FIG. 5 is a cross-sectional view of the frame 102 of FIG. 4, taken along line 5-5. As shown, the frame 102 includes locking cavities 801 into which accessories or other devices may be inserted and locked into position. Such accessories or devices may include aesthetic components, theatrical components, structural components, or any other components useful for attachment to frame 102. Structural components may include locking keys 803 engagable in locking cavities 801 on adjacent frame members to vertically align adjacent panels 109 and prevent relative vertical movement that could create a tripping hazard on the platform surface. The locking keys are positioned in a locking cavity 801 on one frame member and project outwardly to engage a locking cavity on an adjacent frame member. The locking key is preferably configured to dimensionally match the opening in the locking cavity of adjacent frames so that as the frames are brought together the keys will inhibit relative vertical movement between the adjacent frames, best illustrated in FIG. 6. The locking keys may be secured in the locking cavities on one frame 102 by mechanical or other means to retain the key in position during erection of the platform. The locking keys may extend substantially the length of the frame 102 or may comprise a plurality of keys spaced-apart along the length of the frame.

The basic structure and arrangement of Applicant's modular stage systems are further disclosed in Applicant's U.S. Pat. No. 8,136,460, Portable Locking Support and Platform System, U.S. Pat. No. 9,082,325, Platform System, Video Module Assembly, and Process of Assembling Platform system, and U.S. Pat. No. 9,259,639, Self-Leveling Platform System, Self-Leveling Supports, and Method of Assembling a Self-Leveling Platform System, the descriptive portions thereof are incorporated by reference herein.

In one embodiment of the platform system, one or more panel sections 109 and supporting frames 102 are replaced by an adjustable wedge deck panel module 300 to allow the platform deck to be configured with curved portions. An exemplar stage arrangement is provided in FIG. 7. The adjustable wedge deck panel module 300 is configured to interface with and be connectable to other frames 102 in the platform system, rely on the same portable supports 103 as used elsewhere in the platform system, and be easily integrated into any state reliant on the modular platform system described above.

Figure 8:
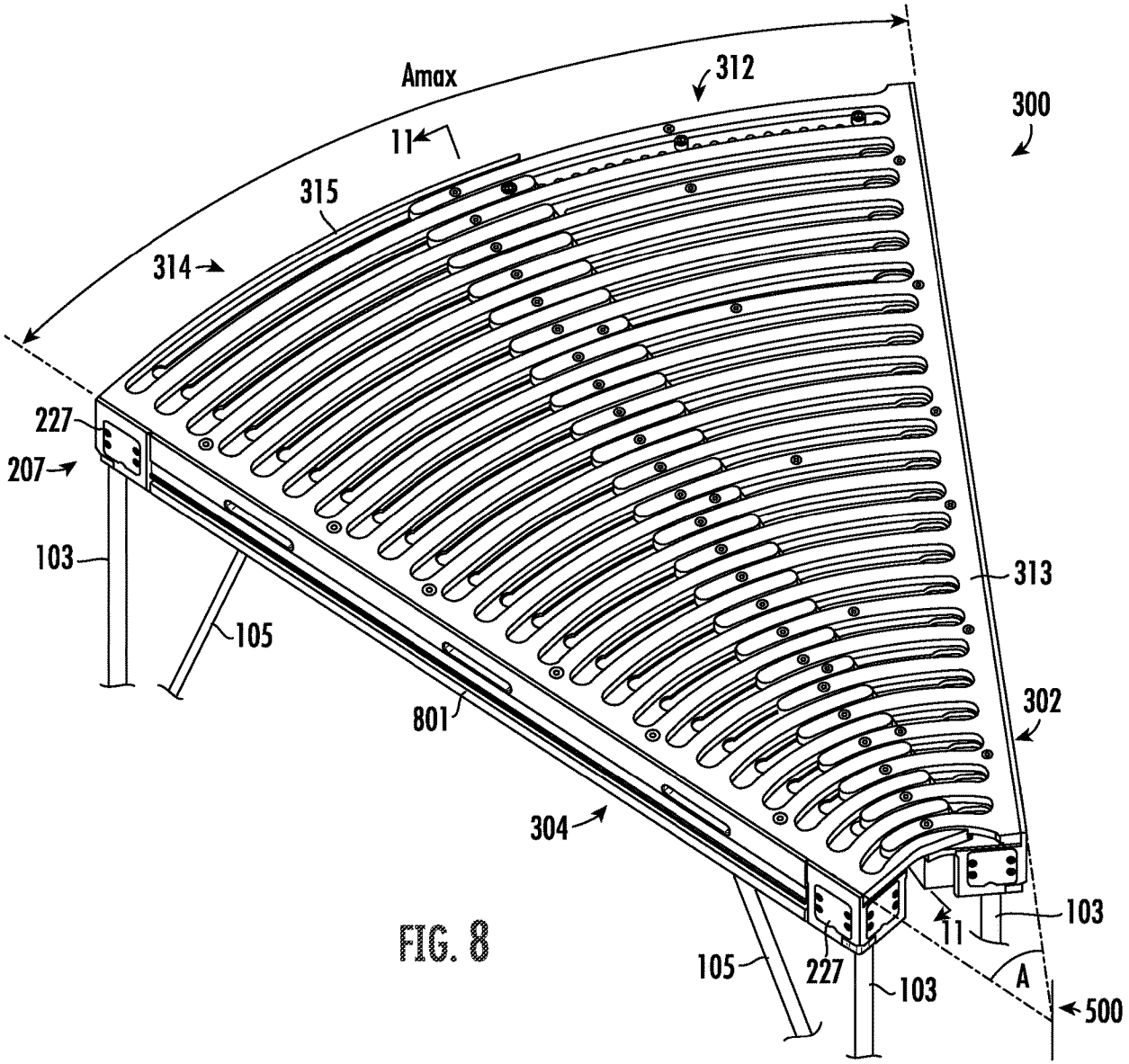
FIG. 8 is a partial perspective view of an adjustable wedge panel module incorporating aspects of the present invention and shown in a first configuration.
Figure 9:
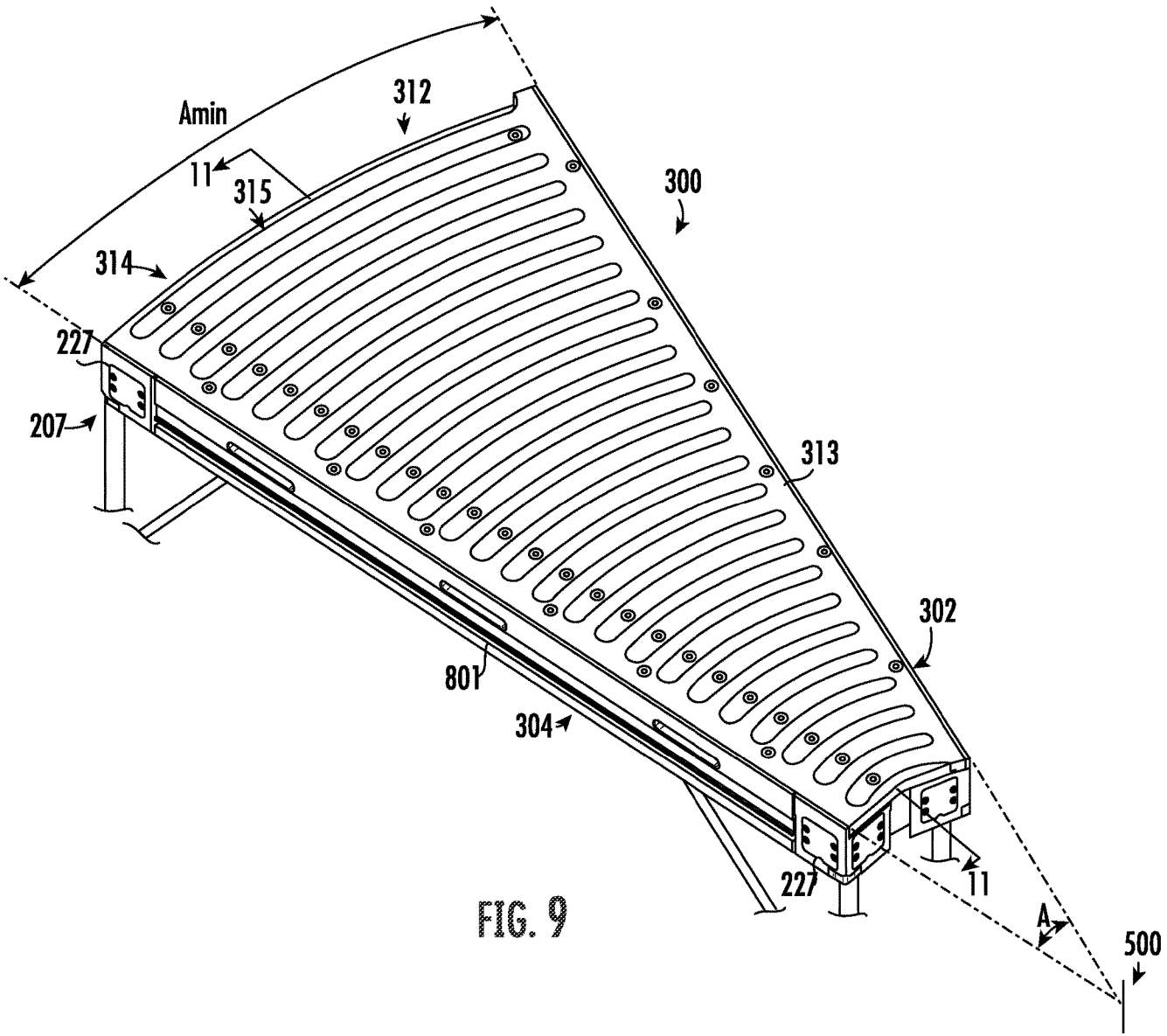
FIG. 9 is a partial perspective view of the adjustable wedge panel module of FIG. 8 shown in a second configuration.
Figure 10:
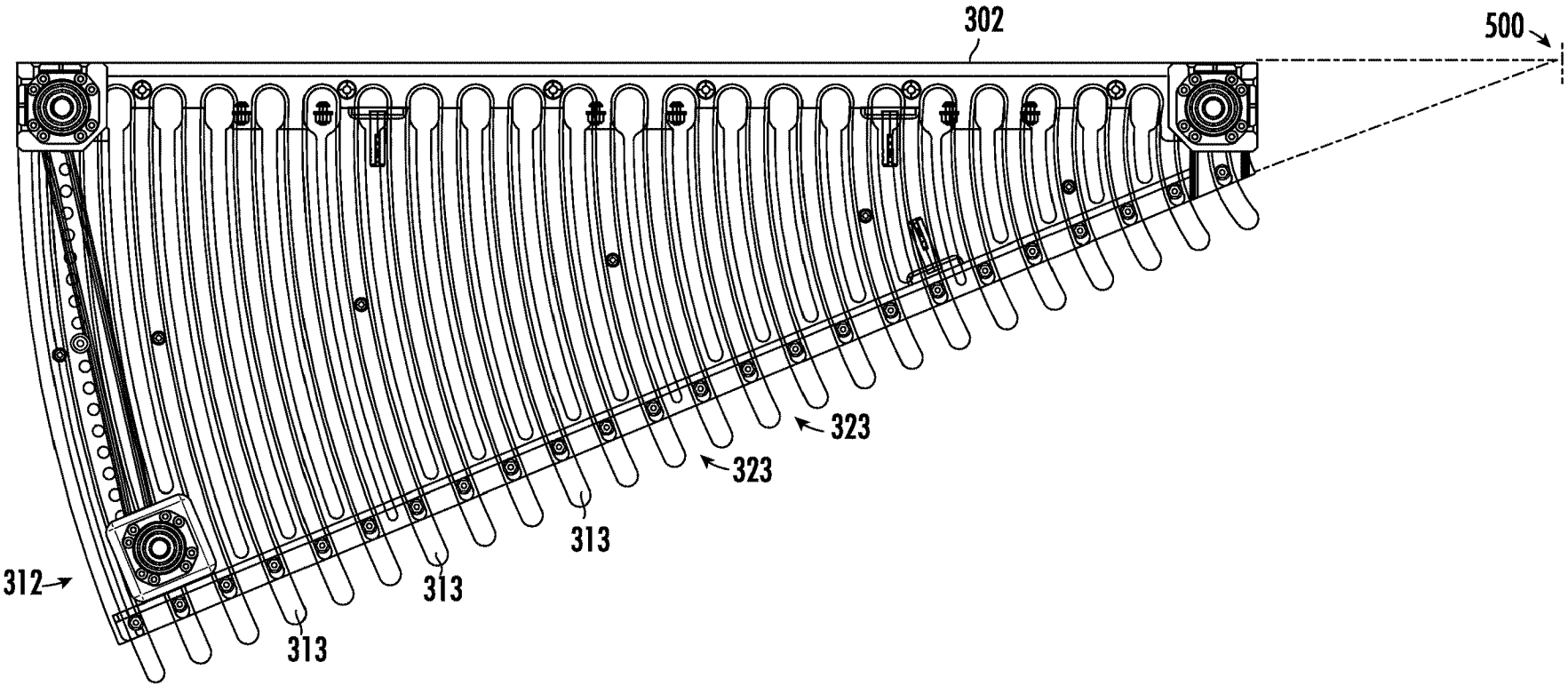
FIGS. 10 and 11 are partial plan view of first and second platform panels sections of the show an alternative view of the expandable deck module of FIGS. 7 and 8, the modules being shown in a retracted configuration.
Figure 11:
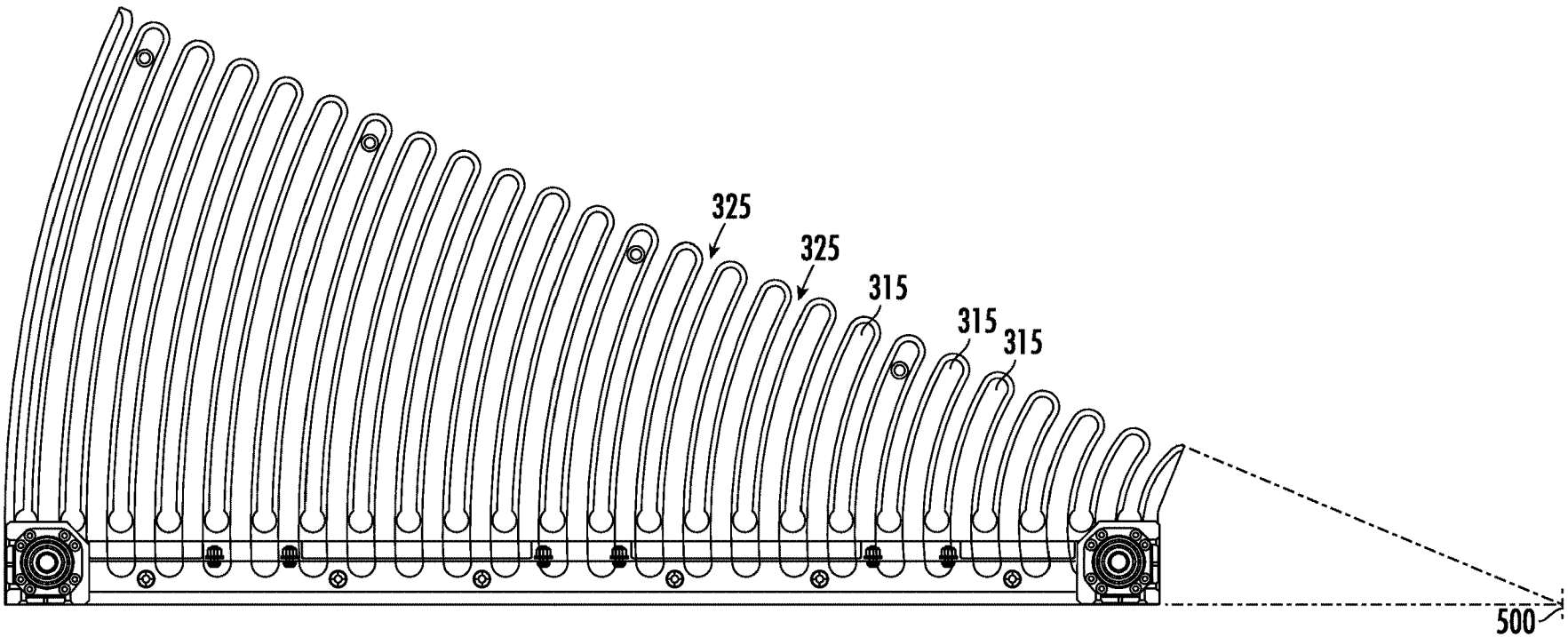
Figure 12:
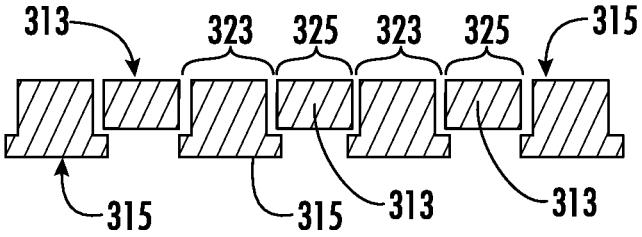
FIG. 12 is a partial section view of FIG. 8 taken along cut line 12-12 detailing an embodiment of the intermeshing fingers of the deck panel of the expandable deck module.

As illustrated in FIGS. 8 through 12, the adjustable wedge deck panel module 300 includes a first frame 302 and a second frame 304. The first and second frames 302, 304 respectively support first and second platform panel portions 312, 314 which form two portions of the panel module. Each panel portion 312, 314 comprises a plurality of intermeshing, arced combs 313, 315 and spaces 323, 325 concentrically arranged about a pivot center 500. The pivot center 500 may be mechanically established, as by a pivot axle, or may be a virtual pivot center established by the curvature of the intermeshing combs. The pivot center 500 may be positioned proximate an edge of the panel module or it may be positioned at a point space apart from the platform module. These intermeshing combs guide movement of the first and second frames 302, 304 so that they are pivoted about pivot axis 500 and are aligned on individual radii extending from the pivot axis. The first and second frames define a sector angle "A" therebetween. When minimally angled, the sector angle $A_{min}$ between the first and second frames may be as little as 15 degrees (FIG. 9). When maximally angled, the sector angle $A_{max}$ between the first and second frame may be as much as 90 degrees (FIG. 8). Limitations of the intermeshing combs control the angling movement define the minimum sector angle to be approximately one-half of the maximum sector angle. In an embodiment, the first and second frames are moveable between a minimum sector angle $A_{min}$ of 22.5 degrees and a maximum sector angle $A_{max}$ of 45 degrees allowing the adjustable wedge panel to be easily configured to circular sectors increments of 1/16 or 1/8 of a full circle. Assembling two adjustable wedge panels, fully expanded, adjacently, produces a wedge segment sweeping a 90-degree annular sector. Such a configuration allows a rectangular stage to include rounded corners or the change the direction of a bridge stage by 90 degrees. Moreover, a single wedge module design can be adapted to produce many different angled sweeps, eliminating the need to produce and deploy a multitude of fixed-angle wedge-shaped modules.

The arced, intermeshing combs of the panel portions each include a plurality of spaced-apart arced fingers 313, 315 extending toward one another from respective first and second frame 302, 304. The fingers 313, 315 are configured to slide past one another as the frames are moved and to guide the frames and panel portions in an arc-like motion. The fingers 313 on the first panel portion connected to the first frame 302 are positioned to fit within the spaces 325 between the fingers 315 on the comb connected to the moveable frame and vice-versa. The fingers 313, 315 are further configured such that the upfacing surface portions thereof are substantially co-planar as the fingers intermesh, forming a substantially level surface suitable for integration into a modular platform system. The respective comb panels are fixedly attached to their respective frames 302, 304 in a manner creating unitary structures, angling movement of the two structures about pivot center 500 being controlled by the sliding interface of the curved, intermeshing fingers 313, 315.

When the wedge deck panel module 300 is in its minimal angled position, the deck surface is substantially free of gaps as the spaces between adjacent comb fingers are filled with comb fingers from the opposite comb panel. When the wedge deck panel is extended to its maximum angle, gaps once filled by the fingers on the opposite comb panel are now open. The configuration of the comb fingers and spacing is such that the openings between adjacent fingers on the same comb are sufficiently narrow to minimize tripping or fall-through hazards on the platform surface. OSHA regulations generally define a hole as an opening that is at least two inches in its least dimension and thus serves as a maximum limit for gaps between adjacent fingers in the comb panel support surface.

The first and second frames 302, 304 are moveable about a pivot center 500 so that the sector angle "A" between the first and second frames 302, 304 may be varied. The first and second platform panel portions 312, 314 are configured to allow angling movement of the respective panel portions while providing a usable platform surface substantially free of gaps, openings, raised edges, or other irregularities which could pose a tripping hazard to a person on the surface. The wedge deck platform panel portions provide sufficient strength to meet a defined load-carrying rating of the platform system.

The first and second frames 302, 304 are provided with connection interfaces consistent with other frames 102 and panel sections 109 or other wedge deck panel modules used in the modular platform system, including receiving members incorporating magnetic panels, frame alignment locking cavities, and retention mechanisms. This configuration allows the adjustable wedge deck panels to be incorporated into any modular platform system and configured into a desired stage arrangement.

First and second frames 302, 204 are attached to one or more receiving members 207 allowing connection of support members 201 on the underside of the frames to support them in an elevated position in the same manner as other frames 102 and panels 109 comprising the platform system 101. Magnetic panels 227 may be provided on the receiving members 207 on the frames 302, 304 to align them with adjacent frame panel sections. First and second frames 302, 304 may also be provided with alignment means such as locking cavities 801 disposed on the frame periphery into which locking keys 803 may be inserted to align the adjacent frames frame and thus the top surfaces of the panel sections to create an even upward-facing surface when assembled. Retention mechanisms, such as coffin locks 233, may be provided on the first frame 302 and the second frame 304 to secure the adjustable wedge panel to adjacent panel sections to prevent unintentional separation of the adjacent frames while allowing relatively easy disassembly of the platform system by disengaging the retention mechanisms. Engagement of the retention mechanism also assures that the locking cavities and locking keys remain adjacent and engaged to further resist vertical relative displacement between adjacent panel assemblies.

The wedge deck panel module may include a fixing mechanism to restrain the first and second frames in a fixed angular position. The fixing mechanism may be configured to restrain the frame in any angled position within the adjustment range to prevent unintended movement during assembly or disassembly of the platform system. The fixing provisions may include detents or other provisions such as friction brakes, clamping mechanisms, locking pins, or any means of selectively immovably securing the frames. The fixing provisions may be configured to secure the first and second frames in one or more commonly used angular relations, including 22.5, 30, and 45 degrees to enable curved platforms to be quickly and easily erected.

Figure 7:
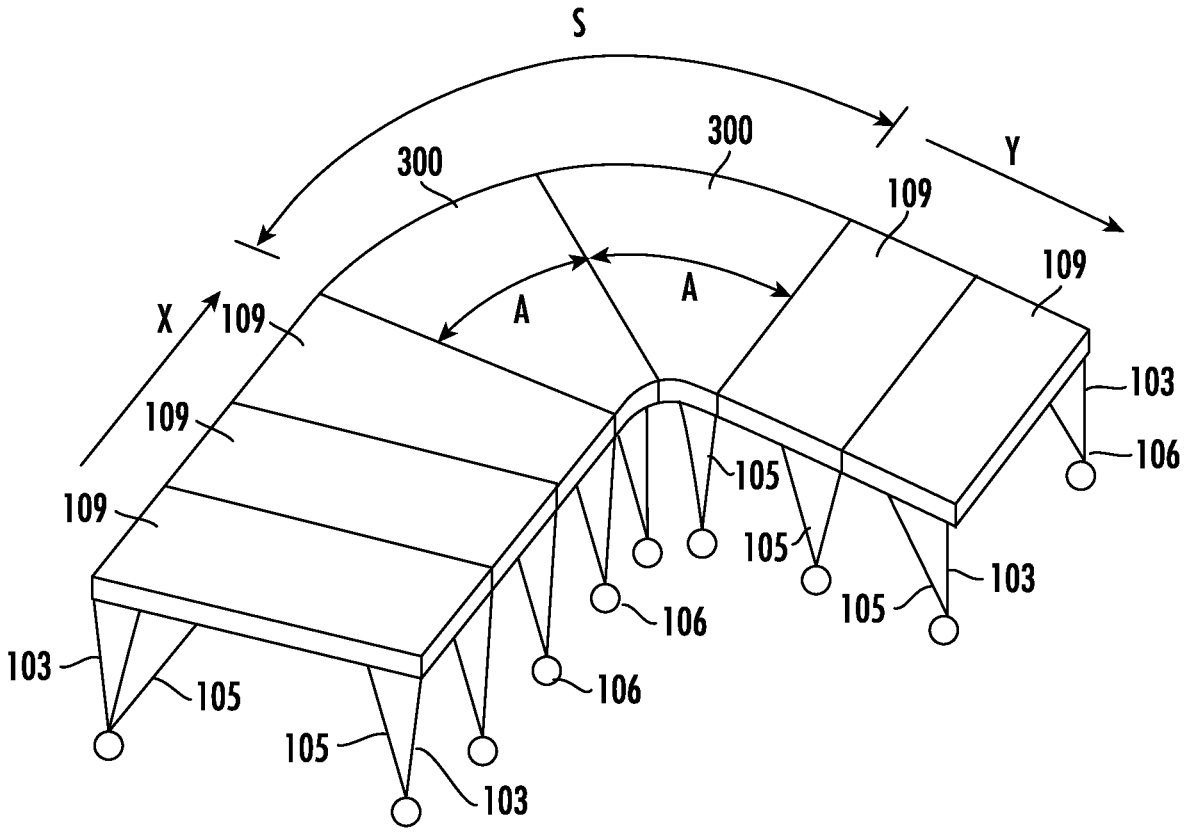
FIG. 7 show a view of a modular platform system incorporating curved sections in which the present invention is useful.

Referring to FIG. 7, a portion of an exemplar platform system is shown incorporating a pair of adjustable wedge deck panel modules 300 positioned to allow platform runway to curve from direction "X" to direction "Y." The layout of the platform system dictates a desired angle "S" (sector angle) for the sweep of the curve in the platform. An adjustable wedge panel module 300 is angularly adjusted to the desired angle. In the event that the desired angle exceeds the capability of a single adjustable wedge panel, additional adjustable wedge panels may be joined to the first and adjusted so that the combined angle of the connected wedge panels equals the desired angle. For example, if a 90-degree turn (sector angle "S") in the platform bridge is desired and each adjustable wedge has a maximum adjustment of 45 degrees (sector angle A), two wedge panels will be necessary to make the curve in the platform, each adjusted to their maximum sector angles. Angular adjustment of the adjustable wedge panels may be performed before or after the wedge panel is positioned and secured to an adjacent modular panel.

Integrating the wedge panels into the platform system requires supporting the adjustable wedge panel above a surface by engaging a portable support member into the receiving members of the first and second frames. Frame members of the wedge panels 300 are aligned with frame members on adjacent panel assemblies in the modular platform system using the magnetic panels 227, locking cavities, and locking keys 803 present on adjacent frame members. Once aligned, frame members of the wedge panels 300 may be secured to adjacent frame members by engaging retention mechanisms, such as coffin locks 233, to prevent untended separation of the modular panels comprising the platform assembly.

While the exemplary embodiments illustrated in the figures and described herein are presently preferred, it should be understood that these embodiments are offered by way of example only. Accordingly, the present application is not limited to a particular embodiment, but extends to various modifications that nevertheless fall within the scope of the appended claims. The order or sequence of any processes or method steps may be varied or re-sequenced according to alternative embodiments.

It is important to note that the construction and arrangement of the various exemplary embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited in the claims. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present application. The order or sequence of any process or method steps may be varied or re-sequenced according to alternative embodiments. In the claims, any means-plus-function clause is intended to cover the structures described herein as performing the recited function and not only structural equivalents but also equivalent structures. Other substitutions, modifications, changes and omissions may be made in the design, operating conditions and arrangement of the exemplary embodiments without departing from the scope of the present application.

The invention claimed is:

1. An adjustable wedge panel module for a modular platform system comprising:

a static frame having a receiving member and a first platform portion, the first frame being supportable above a surface by a portable support member engaged in the receiving member; and a moving frame having a receiving member and a second platform portion, the second frame being supportable above a surface by a portable support member engaged in the receiving member and angularly moveable relative to the static frame;

wherein the first and second platform portions remain substantially co-planar as the static and moving frames are moved between a first angular position and a second angular position, wherein the adjustable wedge panel module is self-contained and configured to be selectively adjusted to a predetermined sector angle while supported above the surface by the portable support member, and wherein the first and second platform portions comprise slidingly intermeshing comb panels that guide angular movement while maintaining a continuous walking surface.

2. The adjustable wedge panel module of claim 1, wherein the static frame and the moving frame each extend along a radius defining a sector angle therebetween, the first and second platform portions defining an annular sector spanning between the static frame and the moving frame.

3. The adjustable wedge panel module of claim 2, wherein the sector angle ranges between 20 degrees and 50 degrees.

4. The adjustable wedge panel module of claim 1, wherein the respective platform portions comprise intermeshing combs each including an upfacing surface portion substantially co-planar with the other.

5. The adjustable wedge panel module of claim 4, wherein the intermeshing comb associated with the static frame includes a first plurality of spaced-apart fingers and the intermeshing comb associated with the moving frame includes a second plurality of spaced apart fingers, the first plurality of fingers being configured to slidingly fit in the spaces between the second plurality of fingers to permit bi-directional angular adjustment.

6. The adjustable wedge panel module of claim 5, wherein open space between adjacent fingers of the of the first and second pluralities of spaced-apart fingers is less than two inches when the adjustable wedge panel module is in any angular position.

7. The adjustable wedge panel module of claim 1, wherein the static frame and the moving frame each further comprise a locking channel configured to receive a locking key, the locking key being engageable with a locking channel on an adjacent frame member to inhibit relative vertical movement between adjacent frame members.

8. The adjustable wedge panel module of claim 7, wherein the receiving member further comprises a magnetic panel configured to magnetically attract a receiving member on an adjacently positioned frame member.

9. The adjustable wedge panel module of claim 7, wherein the static frame and the moving frame each further comprise a locking mechanism to selectively retain the static frame and the moving frame in adjacent contact with the adjacent frame member.

10. An adjustable wedge panel for a modular platform system comprising:

a static frame having a receiving member and a first platform portion;

a moving frame moveably coupled to the static frame and angularly adjustable thereto, the moving frame having a receiving member and a second platform portion;

wherein the first platform portion and the second platform portion collectively define a portion of a circular sector having a sector angle defined between the static and moving frames, the first and second platform portions being substantially co-planar irrespective of the angular position of the static frame to the moving frame;

wherein the adjustable wedge panel is configured to be supported by portable support members engaged in the receiving members; and wherein the respective platform portions comprise intermeshing combs concentrically arranged about a center of rotation, each comb including an upfacing surface portion substantially co-planar with the other.

11. The adjustable wedge panel of claim 10, wherein the intermeshing comb associated with the static frame includes a first plurality of spaced-apart fingers and the intermeshing comb associated with the moving frame includes a second plurality of spaced apart fingers, the first plurality of fingers being configured to slidingly fit in the spaces between the second plurality of fingers and allow bi-directional movement about the center of rotation.

12. The adjustable wedge panel of claim 11, wherein open space between adjacent fingers of the of the first and second pluralities of spaced-apart fingers is less than two inches.

13. The adjustable wedge panel of claim 10, wherein each receiving member further comprises a magnetic panel configured to magnetically attract a receiving member on a frame of an adjacent panel assembly.

14. The adjustable wedge panel module of claim 10, wherein the sector angle ranges between 15 degrees and 60 degrees.

15. A method for creating a curved portion in a modular platform comprising:

determining a desired angle for a curved portion of a modular platform;

providing a first adjustable wedge panel having a first frame with a first platform portion and at least a first receiving member, a second frame moveably coupled to the first frame, the second frame having a second receiving member and a second platform portion;

supporting the first adjustable wedge panel above a surface by engaging a portable support member in the first and second receiving members;

angularly adjusting the first frame relative to the second frame to the desired angle; and wherein the respective platform portions comprise intermeshing combs concentrically arranged about a center of rotation, each comb including an upfacing surface portion substantially co-planar with the other.

16. The method of claim 15, further comprising the steps of:

providing a second adjustable wedge panel;

positioning a first frame member of the second wedge panel adjacent to either frame member of the first adjustable wedge panel and securing it thereto; and angularly adjusting the second adjustable wedge panel so that the first and second adjustable wedge panel together span the desired angle.

17. The method of claim 15, further comprising the steps of:

positioning the first frame adjacent to a frame member of a first modular platform assembly; and securing the first frame to the first modular platform assembly frame member.

* * * * *